United States Patent [19]

Tokumitsu et al.

[11] Patent Number: 5,059,102

[45] Date of Patent: Oct. 22, 1991

[54] FLUID SCROLL MACHINE WITH PERIPHERALLY ATTACHED COUNTER WEIGHTS AND REDUCED THICKNESS SCROLL

[75] Inventors: Kiyonori Tokumitsu; Mitsuhiro Nishida; Yasunobu Ozaki, all of Fukuoka, Japan

[73] Assignee: Mitsubishi Denki K.K., Tokyo, Japan

[21] Appl. No.: 397,819

[22] Filed: Aug. 24, 1989

[30] Foreign Application Priority Data

Dec. 13, 1988 [JP] Japan ..... 63-162169[U]
Jan. 13, 1989 [JP] Japan ..... 1-6854

[51] Int. Cl.[5] ..... F01C 1/04
[52] U.S. Cl. ..... 418/55.2; 418/151
[58] Field of Search ..... 418/55 R, 55 A, 151, 418/55.1, 55.2

[56] References Cited

U.S. PATENT DOCUMENTS 3,994,636 11/1976 McCullough et al. ..... 418/55 C
4,490,099 12/1984 Terauchi et al. ..... 418/55 A
4,735,559 4/1988 Morishita et al. ..... 418/151
4,842,499 6/1989 Nishida et al. ..... 418/55.6

FOREIGN PATENT DOCUMENTS 58-172405 10/1983 Japan ..... 418/55 A
61-265376 11/1986 Japan ..... 418/55 A

OTHER PUBLICATIONS

"Rotating Scroll Vacuum Pump", Morishita et al., Proceedings of the 1988 International Compressor Engineering Conference-at Pupdue, vol. 1, 198.

*Primary Examiner*—John J. Vrablik
*Attorney, Agent, or Firm*—Sughrue, Mion, Zinn, Macpeak & Seas

[57] ABSTRACT

A fluid scroll machine whose movable scroll is balanced with a simple construction to decrease the weight and cost of the machine. Counterweights are attached to the peripheral portion of the movable scroll, and the thickness of the engaged portion of the scroll is reduced at the part of the portion, which does not participate in the compression of gas in the machine, so that the scroll is balanced with regard to the rotation thereof. The counterweights are attached to the movable scroll to increase the total mass thereof to balance the scroll. The thickness of the part of the engaged portion of the scroll is reduced to decrease the total mass thereof to balance the scroll. Therefore, the counterweights can be made relatively small.

4 Claims, 2 Drawing Sheets

FLUID SCROLL MACHINE WITH PERIPHERALLY ATTACHED COUNTER WEIGHTS AND REDUCED THICKNESS SCROLL

BACKGROUND OF THE INVENTION

The present invention relates to an improved fluid scroll machine such as a scroll vacuum pump.

FIG. 6 is a sectional view of a conventional fluid scroll machine comprising a casing 1 in which lubricating oil 10 is accumulated at the bottom of the casing, an electric motor 2 provided in the casing and having a rotary shaft 3 supported by a bearing support 4 and a shelf 5, a fixed scroll 6 coupled to the shelf, a movable scroll 7 which is eccentrically rotated relative to the fixed scroll by the rotary shaft, an air feed port 8 communicating with the interior of the fixed scroll, and an air discharge port 9 through which air compressed by the fixed and the movable scrolls is discharged. In the fluid scroll machine, a balancing ring 11 is attached to the rotary shaft 3 to prevent rotative imbalance at the time of the rotation of the movable scroll 7 to keep the machine from undergoing a large vibration. If the machine is small in size, the balancing ring 11 can be made relatively small in size. However, if the machine is middle or large in size, the balancing ring 11 needs to be made middle or large in size. In the latter case, the outside diameter and length of the balancing ring 11 need to be made so large that the cost thereof is high. This is a problem.

In addition, since the rigidity of the engaged portion 7*b* of the movable scroll 7 decreases toward the outer end 7*c* of the portion, the portion is deflected at the outer end thereof outward in the radial direction of the scroll by the pushing force of the end mill machining of the inside portion, as shown by a dotted line in FIG. 7. After the machining is completed, the engaged portion 7*b* returns from the deflected position thereof to the original position thereof due to the elasticity thereof. For that reason, the dimensional accuracy of the finished movable scroll cannot be made high. This is another problem.

SUMMARY OF THE INVENTION

The present invention was made in order to solve the abovementioned problems.

Accordingly, it is an object of the present invention to provide a fluid scroll machine whose movable scroll is balanced with a simple construction to decrease the weight and cost of the machine. Counterweights are attached to the peripheral portion of the movable scroll, and the thickness of the engaged portion of the scroll is reduced at the part of the portion, which does not participate in the compression of gas in the machine, so that the scroll is balanced with regard to the rotation thereof. The counterweights are attached to the movable scroll to increase the total mass thereof to balance the scroll. The thickness of the part of the engaged portion of the scroll is reduced to decrease the total mass thereof to balance the scroll. Therefore, the counterweights can be made relatively small.

It is another object of the present invention to provide a fluid scroll machine in which the dimensional accuracy of the engaged portion of a movable scroll is enhanced at the outer end of the portion with a simple construction. The engaged portion of the movable scroll is provided with a relief means on the inside of the portion at the outer end thereof to enhance the dimensional accuracy of the portion at the outer end thereof. Since the relief means serves to prevent a bending force from acting to the inside of the engaged portion of the movable scroll outward in the radial direction thereof when the scroll is machined, the dimensional accuracy of the engaged portion is improved at the outer end thereof.

It is yet another object of the present invention to provide a fluid scroll machine in which a movable scroll is balanced with a simple construction and the dimensional accuracy of the engaged portion of the scroll is enhanced at the outer end of the portion. Counterweights are attached to the peripheral portion of the movable scroll and the thickness of the engaged portion of the scroll is reduced at and near the outer end of the portion, so that the scroll is balanced with regard to the rotation thereof. The engaged portion is provided with a relief means on the inside of the portion at the outer end thereof to enhance the dimensional accuracy of the portion at the outer end thereof.

DETAILED DESCRIPTION OF EXEMPLARY EMBODIMENTS

Embodiments of the present invention are hereafter described in detail with reference to the drawings attached hereto.

Figure 1:
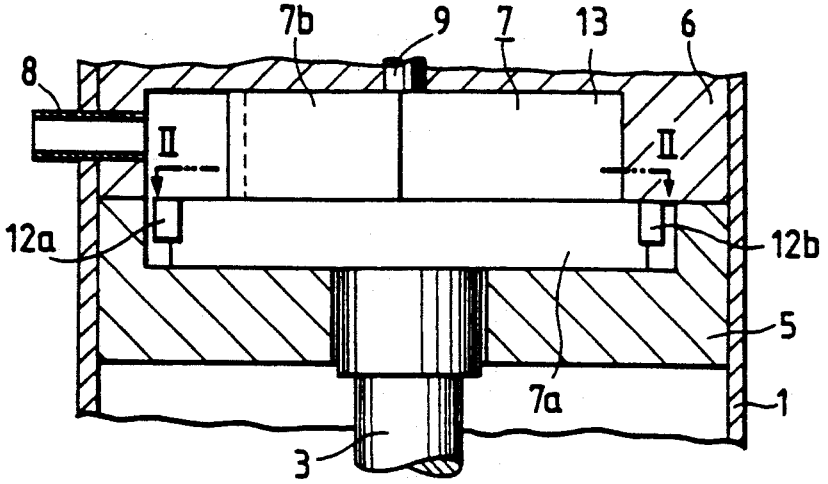
FIG. 1 is a sectional view of a major part of fluid scroll machine which is an embodiment of the present invention.
Figure 2:
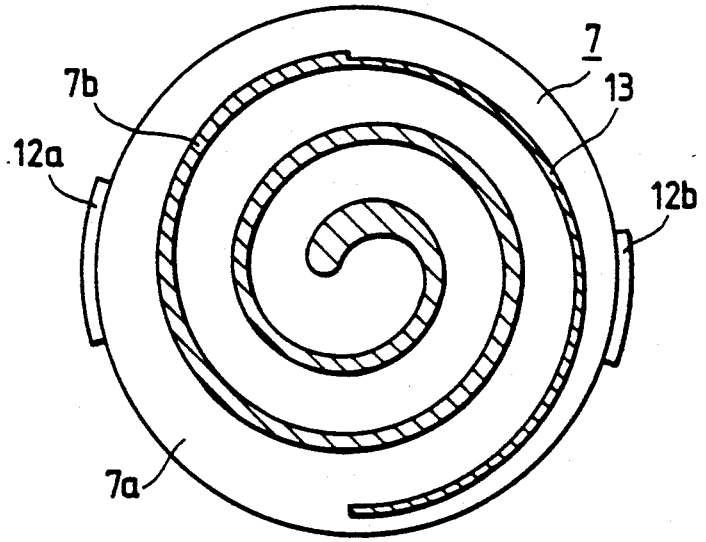
FIG. 2 is a sectional view of a major part of a machine along a line II—II shown in FIG. 1.

FIG. 1 is a sectional view of a major part of a fluid scroll machine which is one of the embodiments. FIG. 2 is a sectional view of the major part of the machine along a line II—II shown in FIG. 1. The machine comprises a casing 1 in which lubricating oil is accumulated at the bottom of the casing, a rotary shaft 3 supported by a bearing support and a shelf 5, a fixed scroll 6 coupled to the shelf, a movable scroll 7 which is eccentrically rotated relative to the fixed scroll by the rotary shaft, an air feed port 8 communicating with the interior of the fixed scroll, an air discharge port 9 through which air compressed by the fixed and the movable scrolls in discharged, and counterweights 12*a* and 12*b* secured to the peripheral portion of the disk shaped body 7*a* of the movable scroll 7 by bolts or the like so as to prevent rotative imbalance. The engaged portion 7*b* of the movable scroll 7 has a reduced-thickness part 13 which does not participate in the compression of the air and is provided to prevent the rotative imbalance. If the masses and positions of the counterweights 12*a* and 12*b* and the reduced-thickness part 13 are predetermined through calculation and the thickness of the engaged portion *7b* of the movable scroll 7 is changed to provide the reduced-thickness part 13 in machining the scroll, balancing adjustment after the machining of the fluid scroll machine before the assembly thereof and balancing adjustment after the assembly do not need to be performed.

Figure 3:
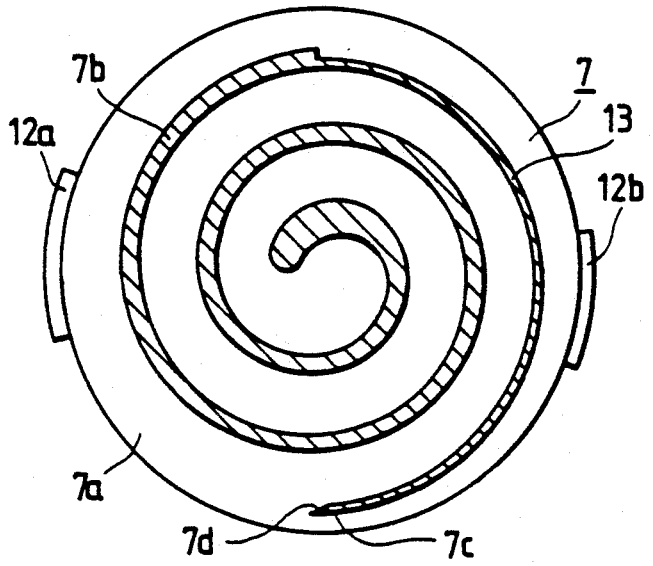
FIG. 3 is a sectional view of a major part of a fluid scroll machine which is another embodiment of the present invention.
Figure 6:
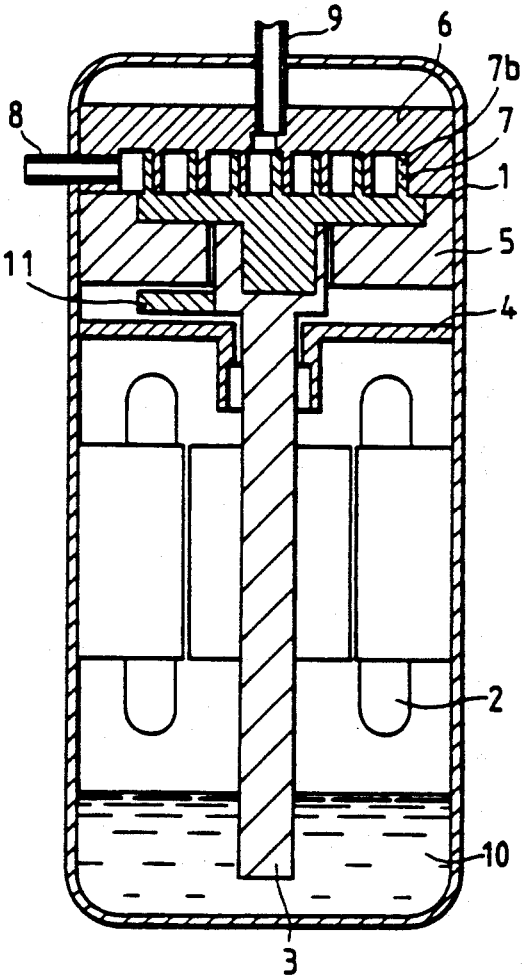
FIG. 6 PRIOR ART
FIG. 6 is a sectional view of a conventional fluid scroll machine.

FIG. 3 is a sectional view of a major part of a fluid scroll machine which is another of the embodiments. The difference of the machine from that shown in FIGS. 1 and 2 is that the machine shown in FIG. 3 has a wedge-shaped notch *7d* on the inside of the engaged portion *7b* of the movable scroll 7 of the machine at the outer end *7c* of the engaged portion. The thickness of the reduced-thickness part 13 of the engaged portion *7b* at the outer end *7c* thereof is gradually reduced toward the outer end by cutting the inside of the engaged portion, so that the wedge-shaped notch *7d* is provided prior to machining of the inside of the engaged portion. The wedge-shaped notch *7d* acts as a relief means so that the engaged portion *7b* is prevented form being elastically deformed at the outer end *7c* thereof due to the reduction in the thickness of the part 13 of the engaged portion when the portion is machined. As a result, the dimensional accuracy of the movable scroll 7 can be made high. Besides, since the wedge-shaped notch *7d* is provided at the outer end *7c* of the engaged portion *7b* by cutting the inside of the engaged portion, a force generated toward an outer peripheral portion of the movable scroll by a cutting resistance is not applied to the engaged portion, so that the engaged portion is prevented from deforming when it is machined.

Figure 4:
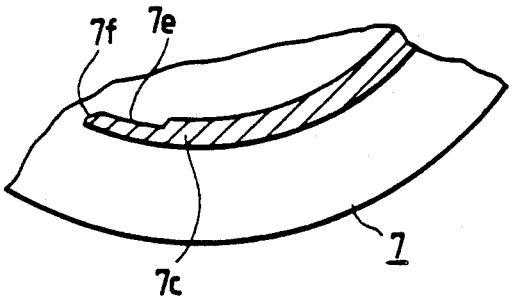
FIG. 4 is a partial sectional view of a major part of a fluid scroll machine which is yet another embodiment of the present invention.

The engaged portion *7b* may be provided with a uniform-thickness notch *7e* at the outer end *7c* of the portion instead of the wedge-shaped notch *7d* by cutting the inside of the portion, as shown in FIG. 4 prior to machining of the inside of the engaged portion. The uniform-thickness notch *7e* acts as a relief means and has a beveling *7f* at the outer end of the engaged portion.

Figure 5:
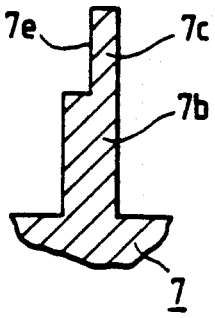
FIG. 5 is a partial sectional view of a major part of a fluid scroll machine which is yet another embodiment of the present invention.
Figure 7:
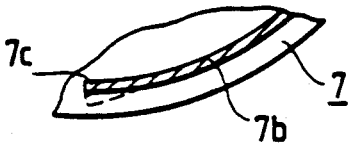
FIG. 7 PRIOR ART
FIG. 7 is a partial sectional view of the conventional fluid scroll machine.

The wedge-shaped notch *7d* and the uniform-thickness notch *7e* may either extend from the bottom of the engaged portion *7b* to the top thereof, or extend only from the middle height of the portion to the top thereof as shown in FIG. 5.

Since the reduced-thickness part 13 of the engaged portion *7b* of each of the fluid scroll machines shown in FIGS. 3 and 4 is provided with the notch *7d* or *7e* by reducing the thickness of the part further, the rigidity of the engaged portion is much decreased at the notch to very effectively prevent the portion from being deformed at the time of machining thereof.

Although the movable scroll 7 is eccentrically rotated relative to the fixed scroll 6 in each of the above-described embodiments, the present invention may be otherwise embodied so that two scrolls are rotated relative to each other and at least one of the scrolls is fitted with counterweights and provided with a reduced-thickness part.

What is claimed is:

1. A fluid scroll machine comprising:

first and second scrolls mounted for movement relative to each other and engaged with each other;

counterweight members attached to a peripheral portion of at least one of said first and second scrolls and disposed symmetrically about an axis of said at least one scroll; and a reduced-thickness part formed at an engaging portion of at least one of said first and second scrolls, said reduced-thickness part not participating in the compression of gas.

2. A fluid scroll machine according to claim 1, in which said engaging portion of at least one of said scrolls has a relief means formed on the inside of said reduced-thickness part at the outer end thereof prior to machining thereof for preventing elastic deformation of said engaging portion during machining.

3. A fluid scroll machine according to claim 2, in which said relief means is a wedge-shaped notch provided on the inside of said reduced-thickness part and extending to the outer end thereof.

4. A fluid scroll machine according to claim 2, in which said relief means is a uniform-thickness notch provided on the inside of said reduced thickness part, prior to the machining of said scroll, and extending to the outer end thereof for preventing elastic deformation of said engaging portion during machining.

* * * * *